US008000625B2

(12) United States Patent
Ito et al.

(10) Patent No.: US 8,000,625 B2
(45) Date of Patent: Aug. 16, 2011

(54) IMAGE FORMING APPARATUS

(75) Inventors: Yoshiyuki Ito, Nagoya (JP); Hakudai Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 354 days.

(21) Appl. No.: 12/392,295

(22) Filed: Feb. 25, 2009

(65) Prior Publication Data

US 2009/0214245 A1 Aug. 27, 2009

(30) Foreign Application Priority Data

Feb. 26, 2008 (JP) ..... 2008-044630

(51) Int. Cl.
*G03G 15/00* (2006.01)
*G03G 21/16* (2006.01)

(52) U.S. Cl. ..... 399/90; 399/111

(58) Field of Classification Search ..... 399/88, 399/90, 111; 439/862, 929; 320/113
See application file for complete search history.

(56) References Cited

U.S. PATENT DOCUMENTS 5,338,231 A * 8/1994 Wilhite ..... 439/862
5,521,693 A 5/1996 Kojima et al.
6,190,193 B1 * 2/2001 Wagner ..... 439/862
2003/0228809 A1 * 12/2003 Howell et al. ..... 439/862
2005/0191079 A1 * 9/2005 Yokoi et al. ..... 399/90
2006/0291893 A1 12/2006 Yano
2007/0154232 A1 * 7/2007 Buchanan et al. ..... 399/90
2009/0247023 A1 * 10/2009 Liao ..... 439/862

FOREIGN PATENT DOCUMENTS

JP 4-337758 A 11/1992
JP 10-301465 A 11/1998
JP 2005-195632 A 7/2005
JP 2007-003925 A 1/2007

OTHER PUBLICATIONS

JP Office Action dtd Apr. 20, 2010 JP Appln. 2008-044630, partial English translation.

* cited by examiner

*Primary Examiner* — Susan S Lee
(74) *Attorney, Agent, or Firm* — Banner & Witcoff, Ltd.

(57) ABSTRACT

An image forming apparatus includes a body frame defining an opening configured to receive a cartridge installed in an installation direction, and a power supply terminal disposed on the body frame. The power supply terminal can be configured to supply power to an installed cartridge by making contact with a power supplied portion disposed in the cartridge The power supply terminal may include a main body protruding from the body frame toward the opening and extending from an upstream side, with respect to the installation direction, toward a downstream side, and an engaging portion disposed upstream from the main body in the installation direction and protruding in a direction orthogonal to the installation direction. The engaging portion may be configured to engage the body frame.

7 Claims, 11 Drawing Sheets

IMAGE FORMING APPARATUS

CROSS REFERENCE TO RELATED APPLICATION

This application claims priority from Japanese Patent Application No. 2008-044630, filed on Feb. 26, 2008, the entire subject matter of which is incorporated herein by reference.

FIELD

Aspects of the invention relate to an electrophotographic image forming apparatus to which a process cartridge is detachably attached.

BACKGROUND

A known process cartridge installed in an electrophotographic image forming apparatus contains consumables such as developer, e.g. toner. The process cartridge is detachably attached to an apparatus body such as a body frame for replacement and refill of the consumables.

Thus, electronic components such as a photosensitive drum, which are held in the process cartridge, are supplied with electric power via a power supply terminal disposed at the body frame. The power supply terminal is elastic and changes its position when the process cartridge is attached to or removed from the body frame.

The power supply terminal includes a terminal main body extending from an upstream side to a downstream side with respect to an installation direction of the process cartridge into the apparatus body. When the process cartridge is installed into the body frame, the terminal main body contacts a power-supplied portion of the process cartridge. Thus, the terminal main body is caused to receive a force in contact with the power-supplied portion. When the force is great during installation of the process cartridge into the body frame, the power supply terminal may separate from the body frame.

SUMMARY

Aspects of the invention provide an image forming apparatus configured to prevent a power supply terminal from separating from a body frame when a process cartridge is installed into the body frame.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. An image forming apparatus according to aspects of the invention applies to a monochrome laser printer 1 as shown in FIG. 1.

Figure 1:
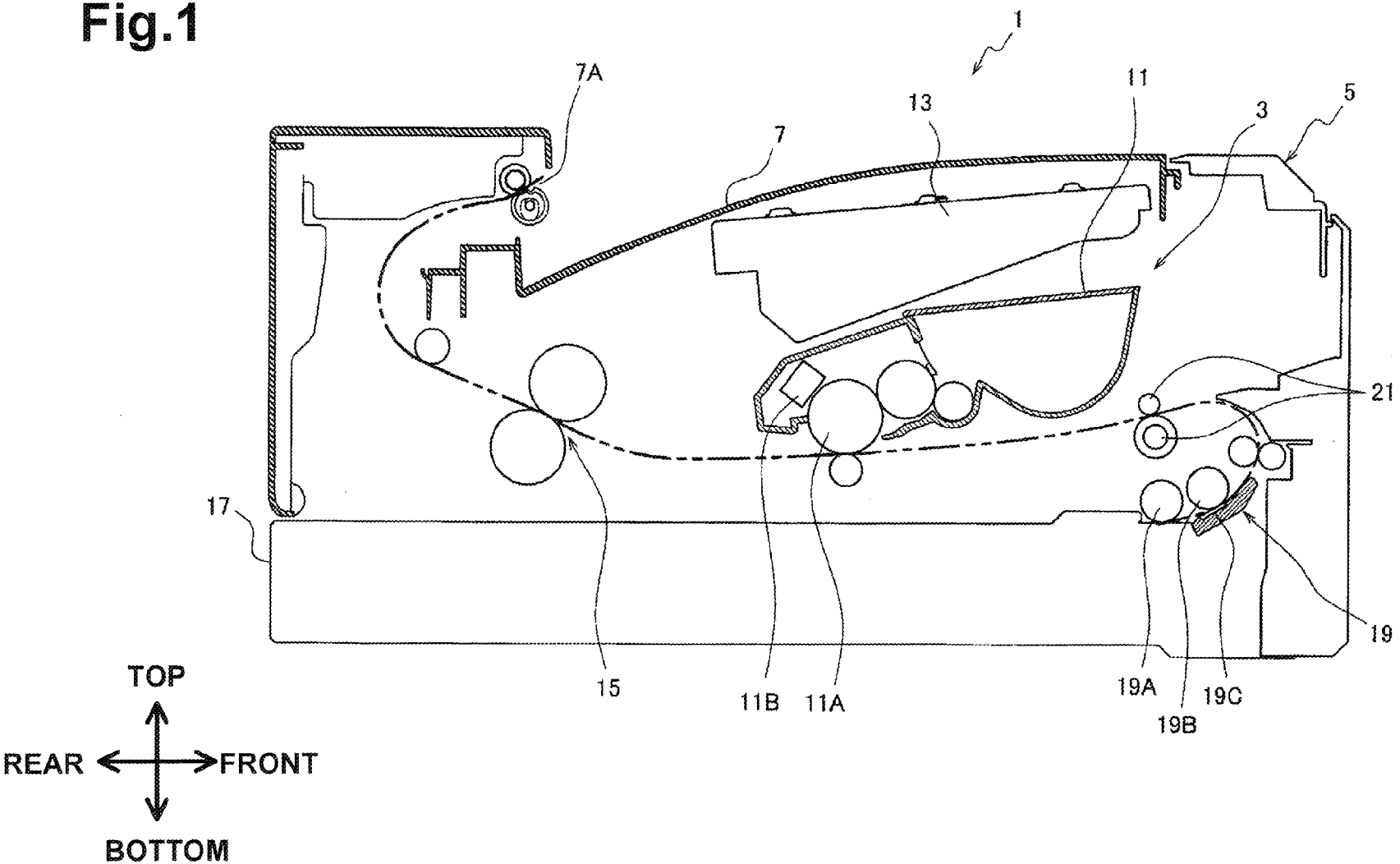
FIG. 1 is a side sectional view of an internal structure of a laser printer as an illustrative example of an image forming apparatus using features described herein.

As shown in FIG. 1, the laser printer 1 may include an electrophotographic image forming unit 3 that is configured to form an image on a recording sheet e.g., plain paper, transparency, etc by transferring a developer image onto the recording sheet. The recording sheet having the image thereon is ejected and placed onto an output tray 7 provided at a top surface of a main body 5.

The image forming unit 3 is accommodated in the main body 5, and includes a process cartridge 11, a light exposing unit 13, and a fixing unit 15.

A sheet supply cassette 17 may be disposed in a lower portion of the main body 5 and configured to load a stack of sheets 4 therein. An uppermost recording sheet is separated and picked up from the stack of recording sheets in the sheet supply tray 17 by a feeder unit 19 including a pickup roller 19A, a separation roller 19B, and a separation pad 19C. The recording sheet is fed between a pair of registration rollers 21 to correct skew of the recording sheet, and then to the process cartridge 11.

A developer image is transferred onto the recording sheet at the process cartridge 11, and the recording sheet having the developer image is heated at the fixing unit 15. The recording sheet is fed upward from the fixing unit 15 and ejected from an ejection portion 7A to the output tray 7.

The process cartridge 11 may include a photosensitive drum 11A, and a charger 11B. The photosensitive drum 11A is configured to carry a developer image thereon, and the charger 11B is configured to charge the photosensitive drum 11A. When the photosensitive drum 11A is charged by the charger 11B, and exposed to light by the light exposing unit 13, an electrostatic latent image is carried or formed on a surface of the photosensitive drum 11A. The electrostatic latent image carried on the photosensitive drum 11A is supplied with developer, and a developer image is carried on the surface of the photosensitive drum 11A.

Figure 4:
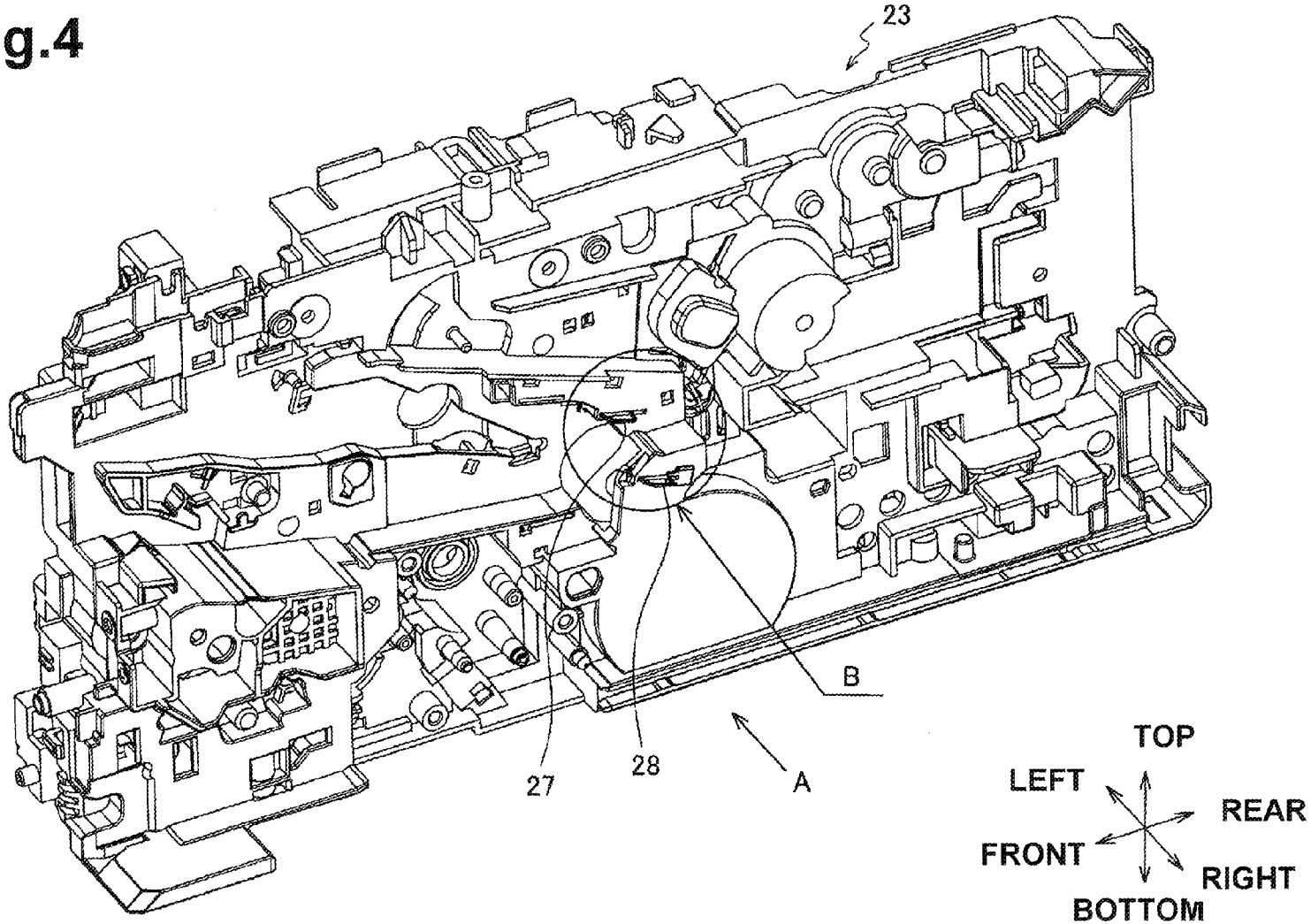
FIG. 4 is a perspective view of a side frame when viewed from inside of the process cartridge.

The process cartridge 11 is detachably attached to a side frame 23 shown in FIG. 4. The side frame 23 is a part of a body frame and is generally plate shaped to have structural strength. The side frame 23 is disposed on each side of the body frame with respect to a width direction or left-right direction of the laser printer 1 within the housing 5.

The side frames 23 disposed on both sides are connected by a beam member (not shown) extending in the width direction. In FIG. 4, the left side frame 23 only is shown.

Figure 2:
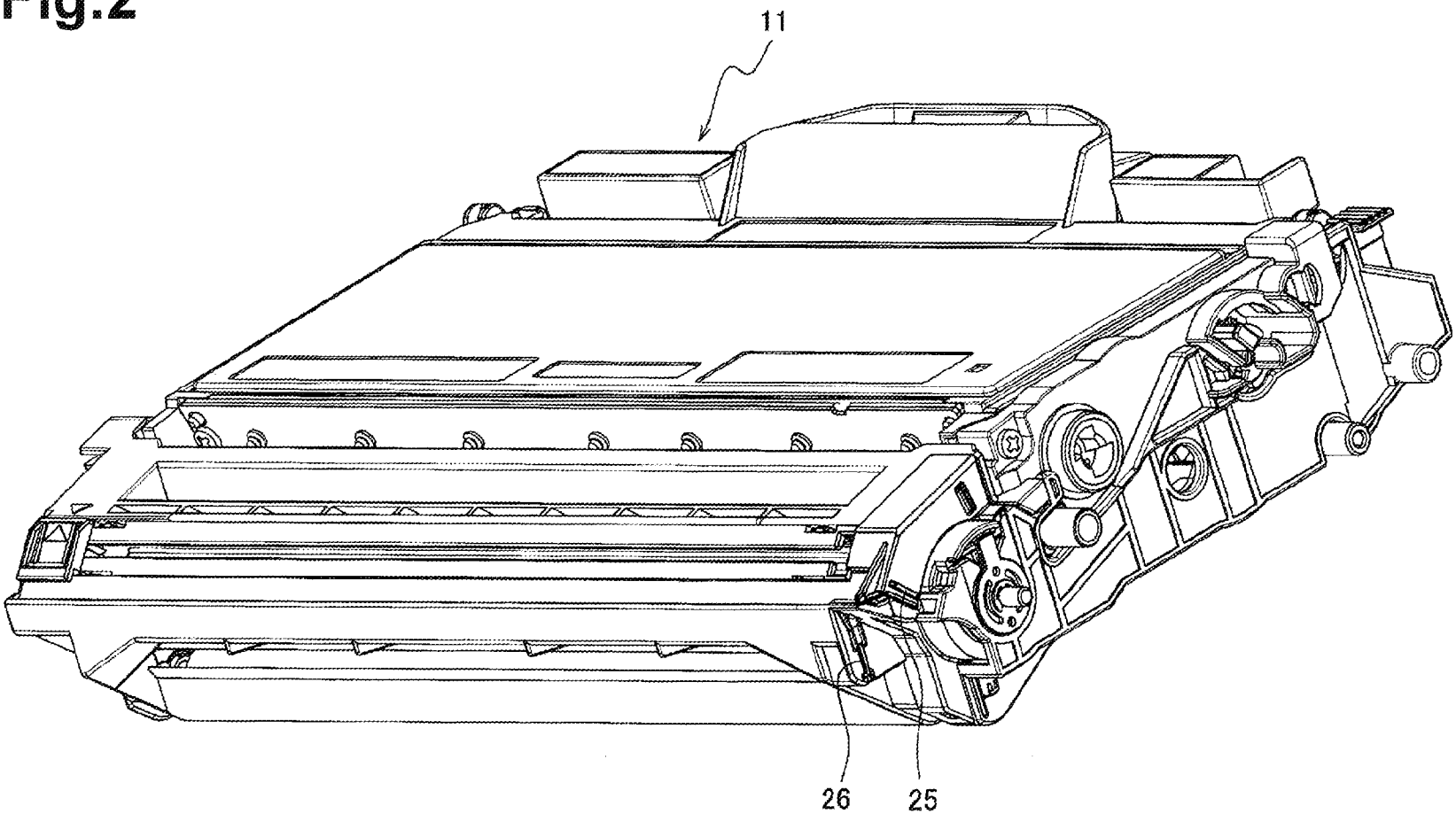
FIG. 2 is a perspective view of an illustrative process cartridge of the image forming apparatus.
Figure 3:
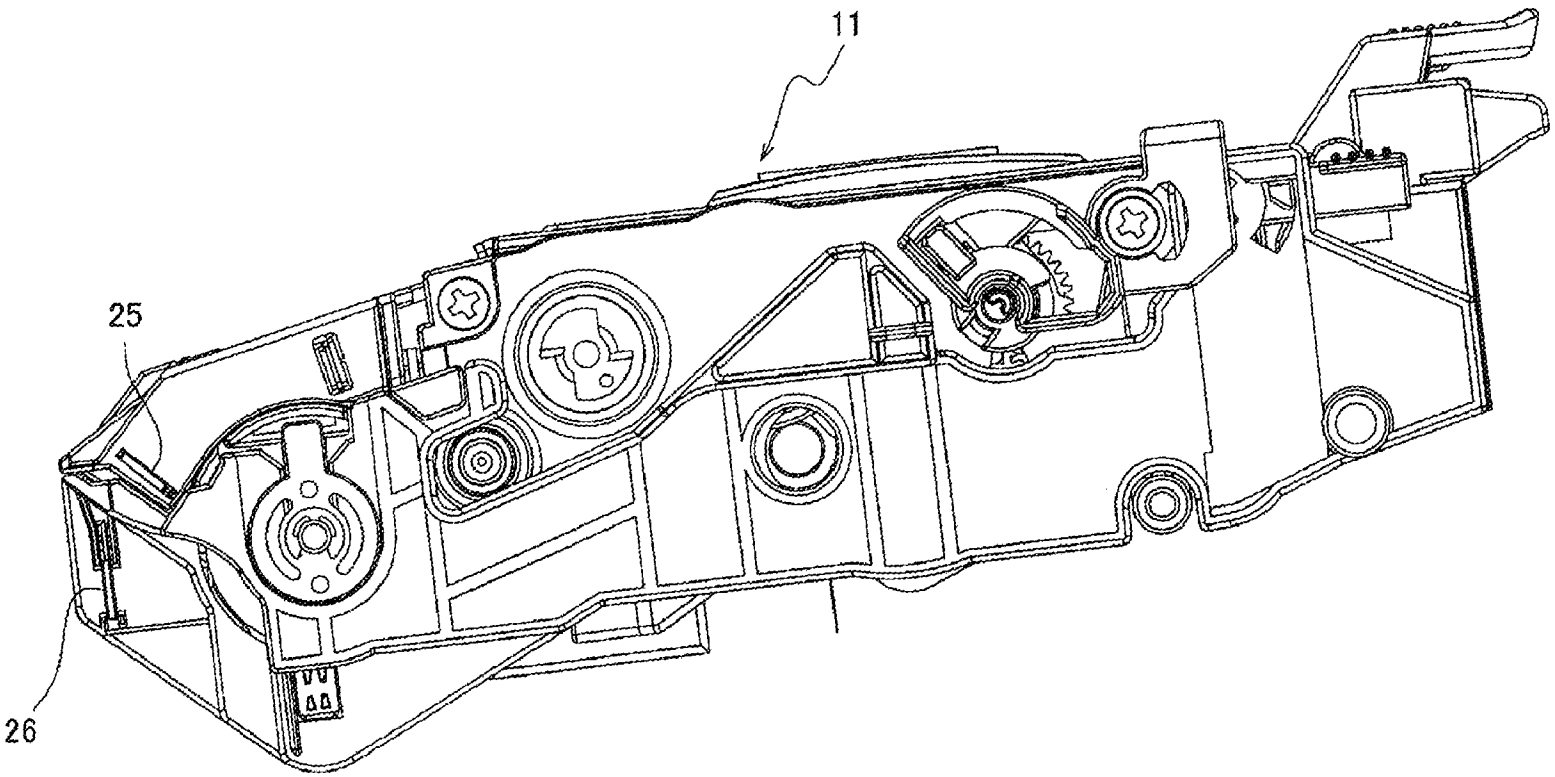
FIG. 3 is a side view of the process cartridge shown in FIG. 2.
Figure 5:
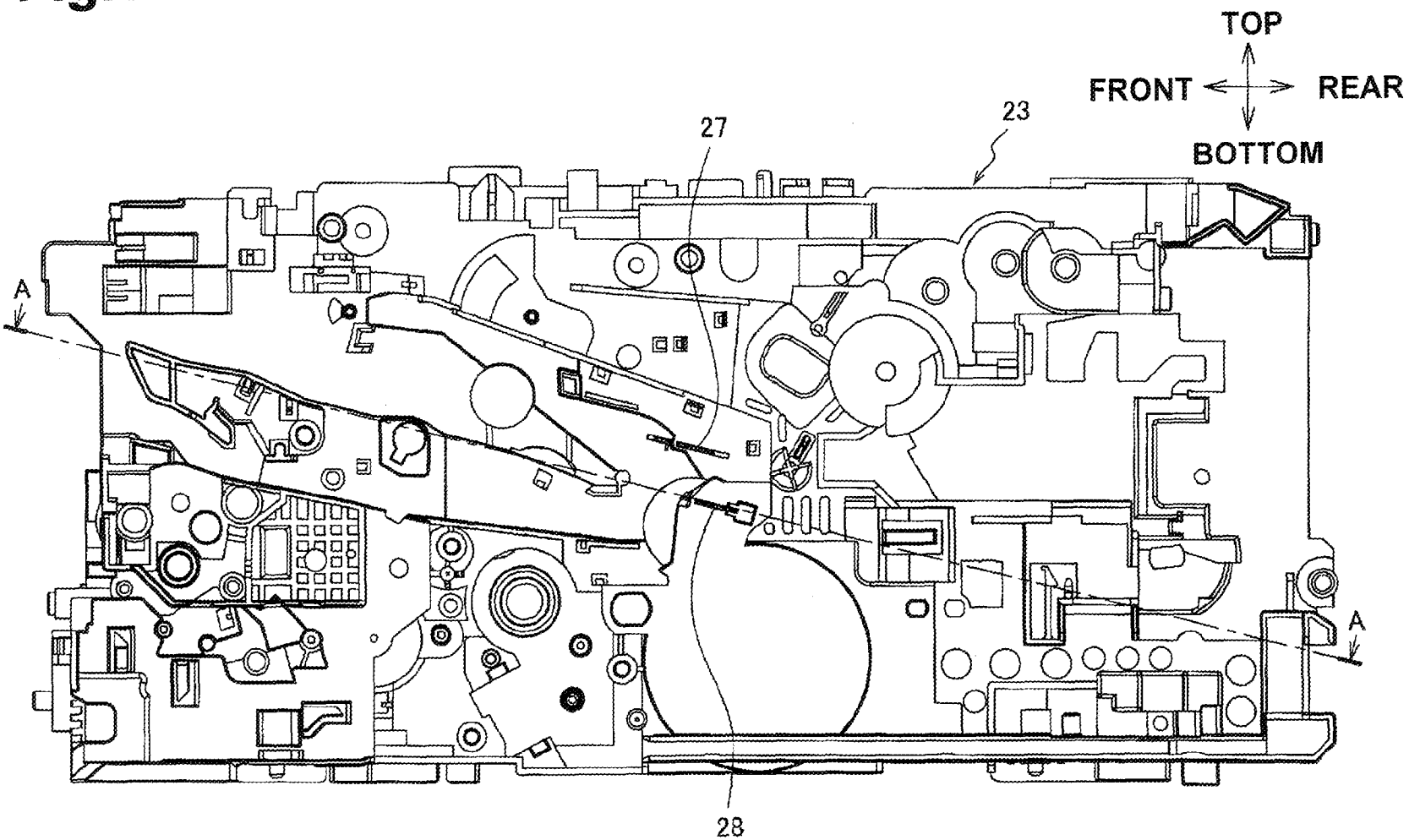
FIG. 5 is a front view of the side frame when viewed in the direction of arrow A of FIG. 4.

When the process cartridge 11 is installed in the side frame 23 of the body frame, power-supplied portions 25, 26 (FIGS. 2 and 3), which are disposed on one side of the process cartridge 11 with respect to a width direction thereof, contact power supply portions 27, 28 (FIGS. 4 and 5), which are disposed at the side frame 23, so that electronic components built in the process cartridge 11 including the photosensitive drum 11A and the charger 11B are supplied with electric power from the body frame as known in the art.

Figure 6:
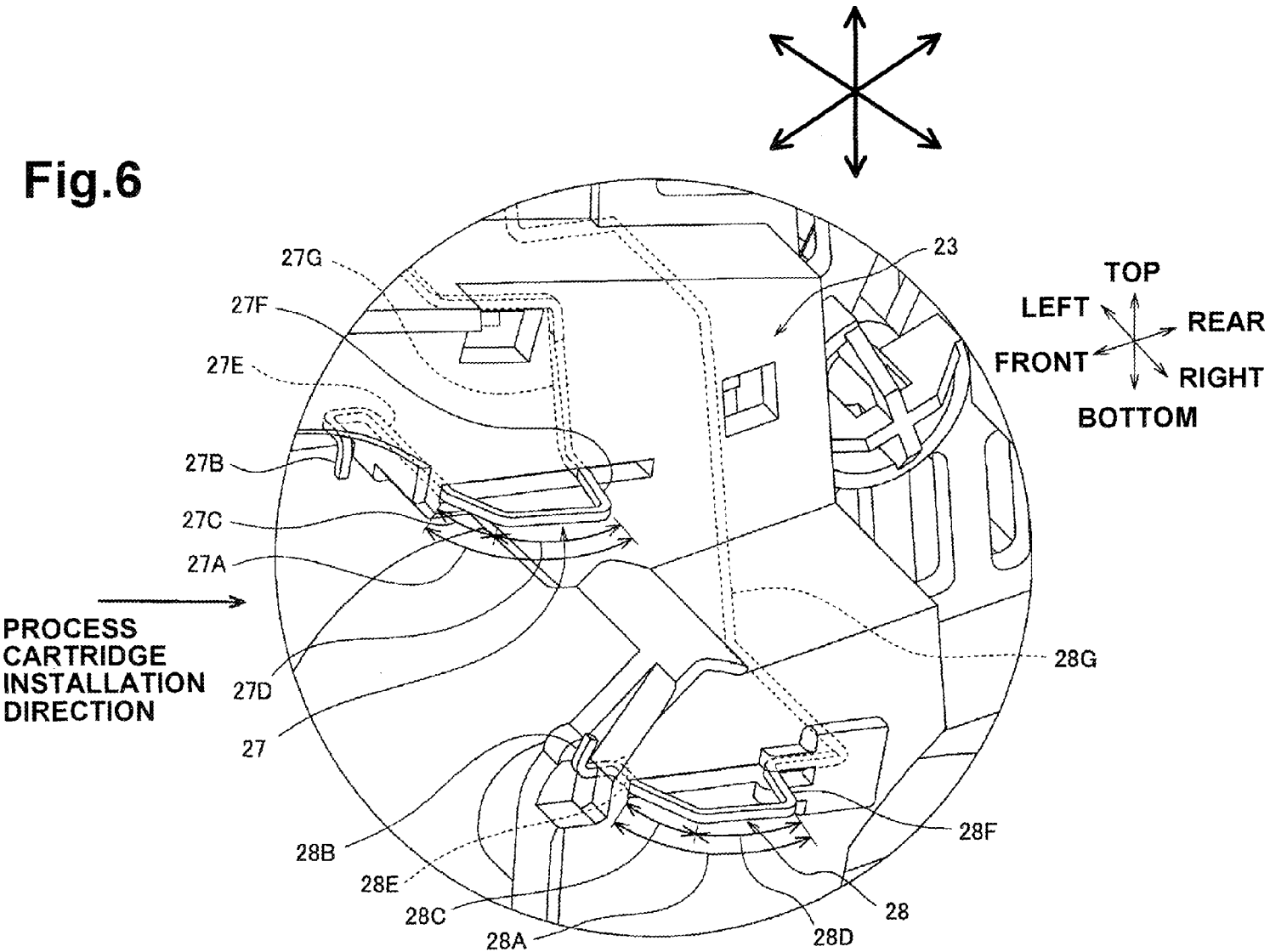
FIG. 6 is an enlarged view of a part B shown in FIG. 4.
Figure 7:
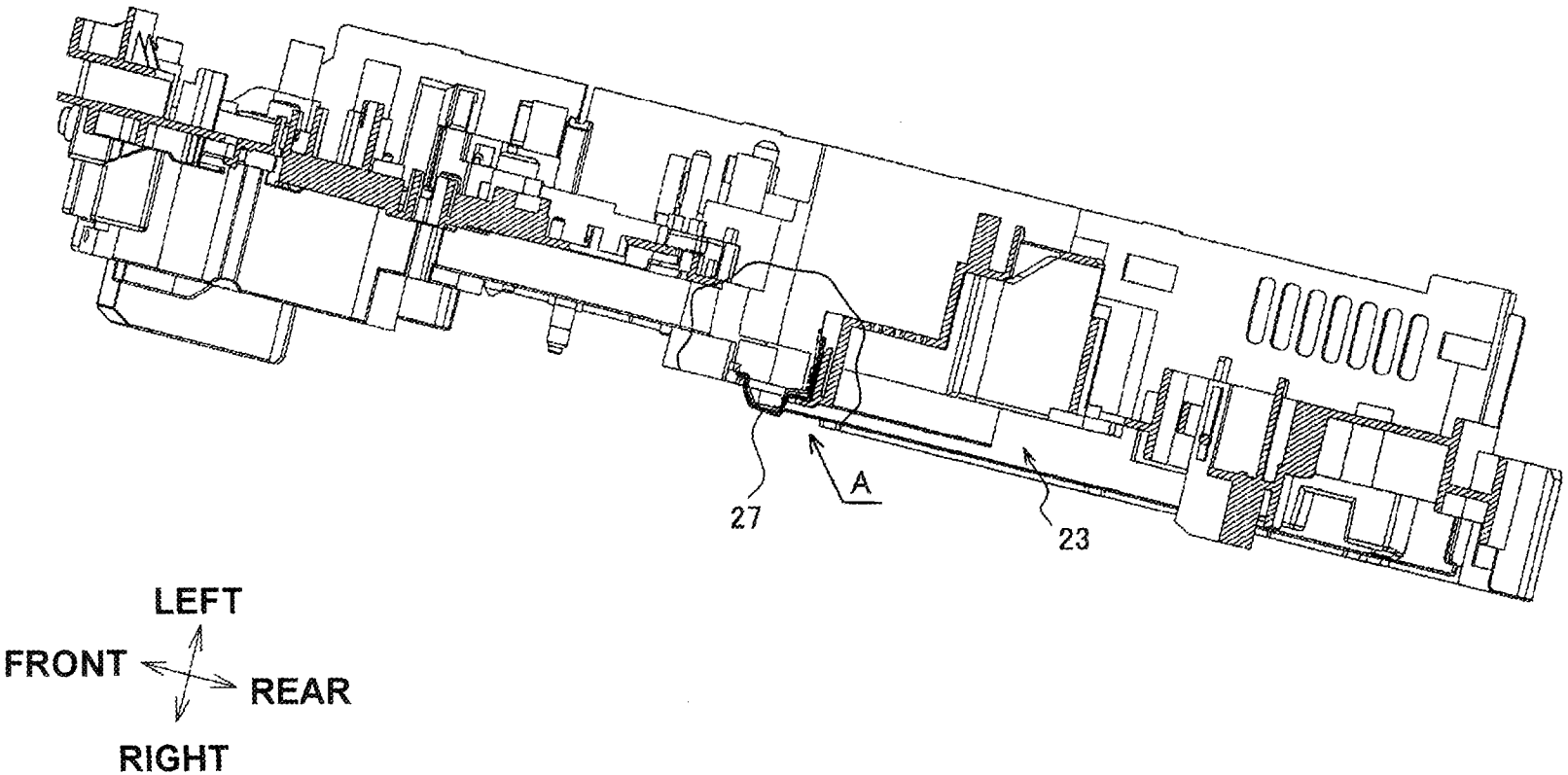
FIG. 7 is a cross sectional view along the line A-A of FIG. 5.

As shown in FIG. 6, the power supply terminal 27 includes a terminal main body 27A and an engaging portion 27B. As shown by a solid line in FIG. 6, the terminal main body 27A protrudes rightward from the side frame 23 or protrudes from the side frame 23 toward the process cartridge 11. In addition, the terminal main body 27A extends in a front-rear direction of the laser printer 1 or from an upstream side to a downstream side with respect to a direction in which the process cartridge 11 is installed (hereinafter referred to as an installation direction). The engaging portion 27B is disposed upstream from the terminal main body 27A in the installation direction, and extends in a direction perpendicular to the installation direction (e.g. in a vertical direction or top-bottom direction in this illustrative embodiment) and engages with the side frame 23.

The terminal main body 27A is formed in a shape like a trapezoid devoid of the longest side, and includes an inclined portion 27C and a contact portion 27D. The inclined portion 27C is disposed upstream from the contact portion 27D in the installation direction.

The inclined portion 27C is inclined in the installation direction such that a side of the inclined portion 27C closer to the engaging portion 27B is disposed toward the side frame 23 in a state where the process cartridge 11 is demounted as shown in FIG. 6. Namely, in this illustrative embodiment, the inclined portion 27C is inclined in the installation direction such that an upstream side or front side of the inclined portion 27C is disposed toward the side frame 23 as opposed to a downstream side or rear side of the inclined portion 27C in the state where the process cartridge 11 is not installed.

A first extending portion 27E is provided at the side frame 23 side of the inclined portion 27C. The first extending portion 27E extends from a side thereof closer to the process cartridge 11 through the side frame 23 toward an inner wall side of the housing 5 (hereinafter referred to as the inner wall side).

The first extending portion 27E is bent in a U shape such that it protrudes toward the inner wall side. An upstream end of the first extending portion 27E extends toward the process cartridge 11 through the side frame 23, and connects to the engaging portion 27B.

The contact portion 27D is configured to contact a power-supplied portion 25 of the process cartridge 11 in a state where the process cartridge 11 is installed in the side frame 23. When the process cartridge 11 is attached to the side frame 23, the contact portion 27D is moved to be generally parallel to the installation direction of the process cartridge 11 or the front-rear direction of the laser printer 1, and contacts the power-supplied portion 25.

A second extending portion 27F is provided at a side of the contact portion 27D opposite from the inclined portion 27C, that is, on a downstream side of the contact portion 27D in the installation direction. The second extending portion 27F extends from the contact portion 27D through the side frame 23 toward the inner wall side. A terminal supporting portion 27G is provided at the inner wall side of the second extending portion 27F. The terminal supporting portion 27G is configured to elastically support the terminal main body 27A such that the terminal main body 27A is movable toward and away from the side frame 23.

Figure 9:
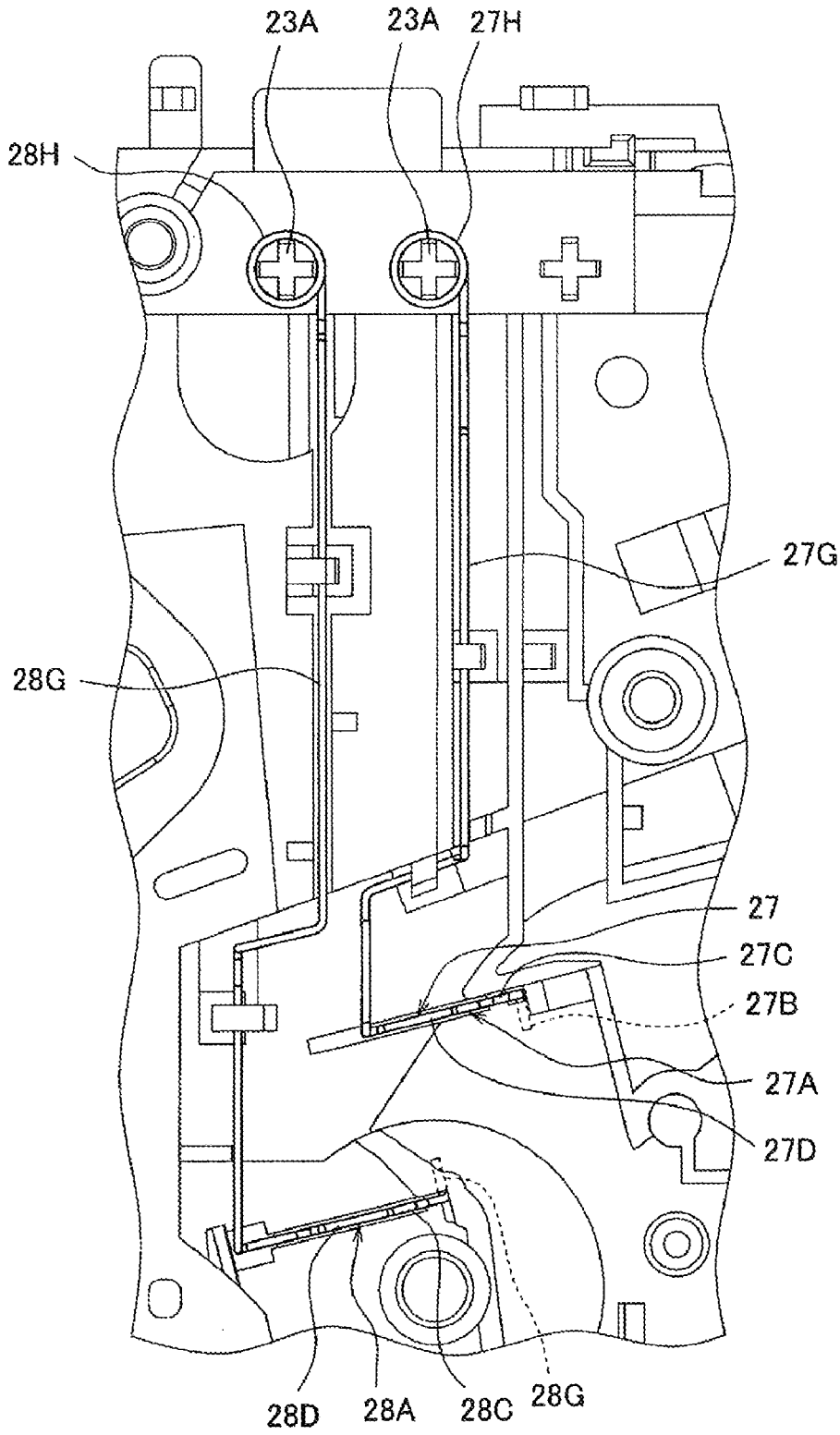
FIG. 9 is a partial rear view of the side frame shown in FIG. 5, to which power supply terminals are attached.
Figure 10:
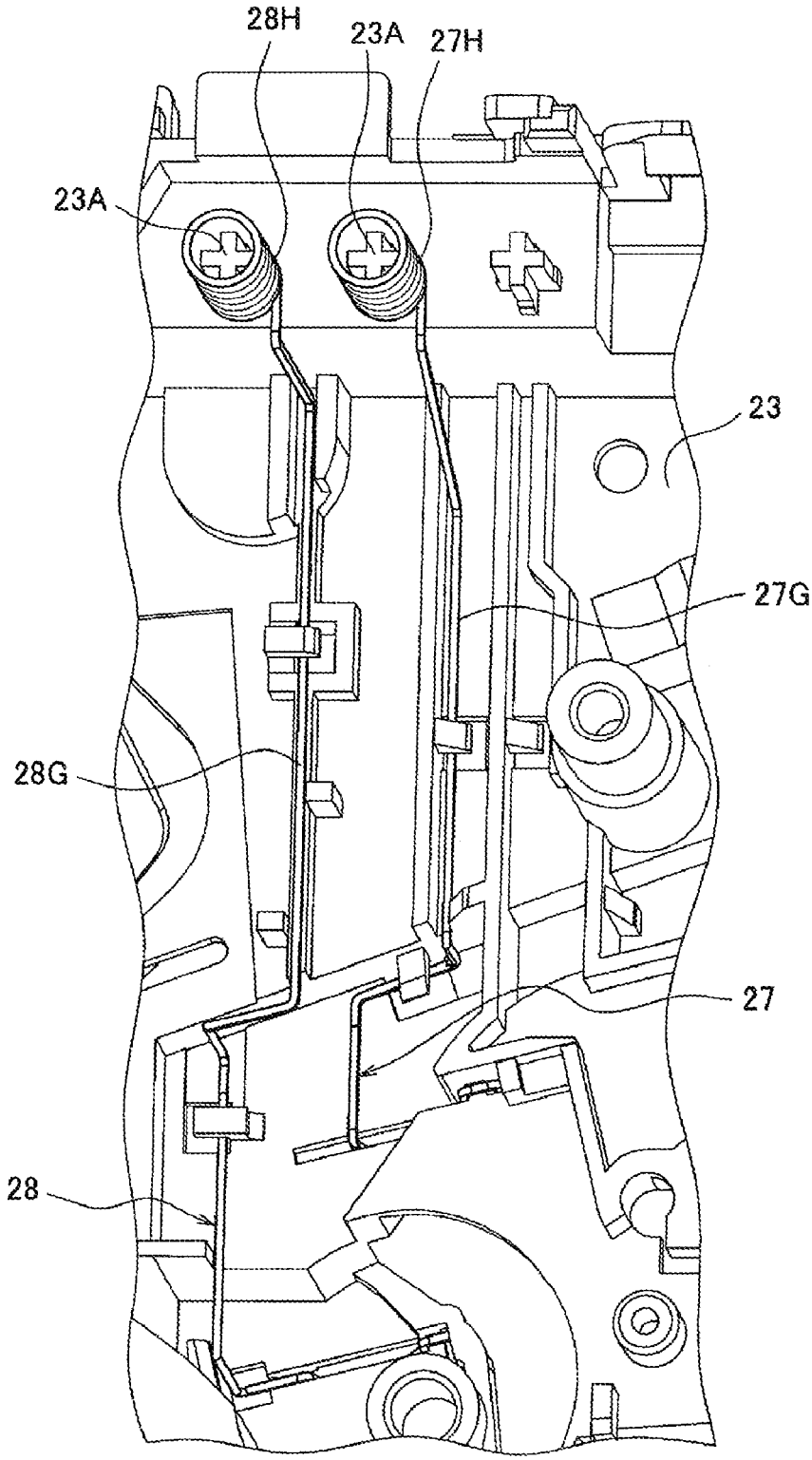
FIG. 10 is a perspective view of the side frame shown in FIG. 9.

As shown in FIGS. 9 and 10, a side of the terminal supporting portion 27G opposite from the second extending portion 27F extends to the upper end of the side frame 23 and an end of the terminal supporting portion 27G is coiled up.

The end of the terminal supporting portion 27G that is coiled up (hereinafter referred to as coiled portion 27H) is fitted around a protrusion 23A provided on the side frame 23, so that the terminal supporting portion 27G is fixed at the side frame 23.

The coiled portion 27H contacts an electrode portion (not shown) provided in a circuit board (not shown) disposed on the inner side surface side of the side frame 23. Electric power is supplied to the power supply terminal 27 via the circuit board.

The power supply terminal 27 of the illustrative embodiment includes the terminal main body 27A (the inclined portion 27C and the contact portion 27D), the engaging portion 27B, the first extending portion 27E, the second extending portion 27F, the terminal supporting portion 27G, and the coiled portion 27H. These portions 27A to 27H are formed integrally from a bent wire S made from metal, as shown in FIG. 11.

In other words, one end of the wire S is bent into the engaging portion 27B. From one end of the wire S toward the other end, the first extending portion 27E, the inclined portion 27C, the contact portion 27D, the second extending portion 27F, the terminal supporting portion 27G, and the coiled portion 27H are shaped in this order. The engaging portion 27B is located at the upstream end of the power supply terminal 27 in the installation direction as shown in FIG. 6.

Figure 11:
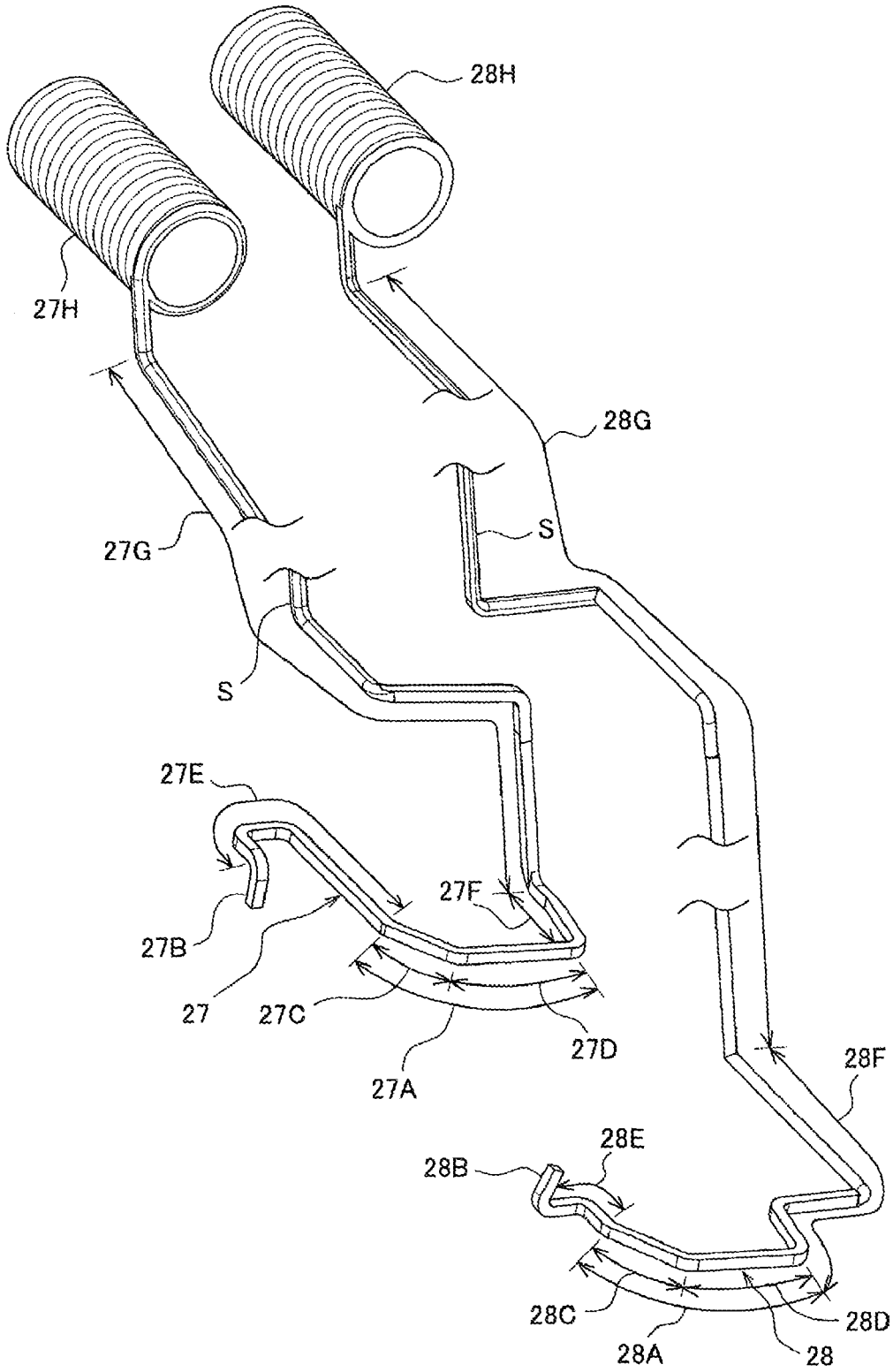
FIG. 11 is a perspective view of power supply terminals.

As shown in FIG. 11, similarly to the power supply terminal 27, the power supply terminal 28 is formed from a bent wire S to include a terminal main body 28A (inclined portion 28C and a contact portion 28D), an engaging portion 28B, a first extending portion 28E, a second extending portion 28F, a terminal supporting portion 28G and a coiled portion 28H.

The power supply terminal 27 is taken as an example to describe how the power supply terminal moves or is deformed while the process cartridge 11 is installed.

As shown in FIG. 9, the power supply terminal 27 is fixed to the side frame 23 at the coiled portion 27H and engages with the side frame 23 at the engaging portion 27B.

Figure 8:
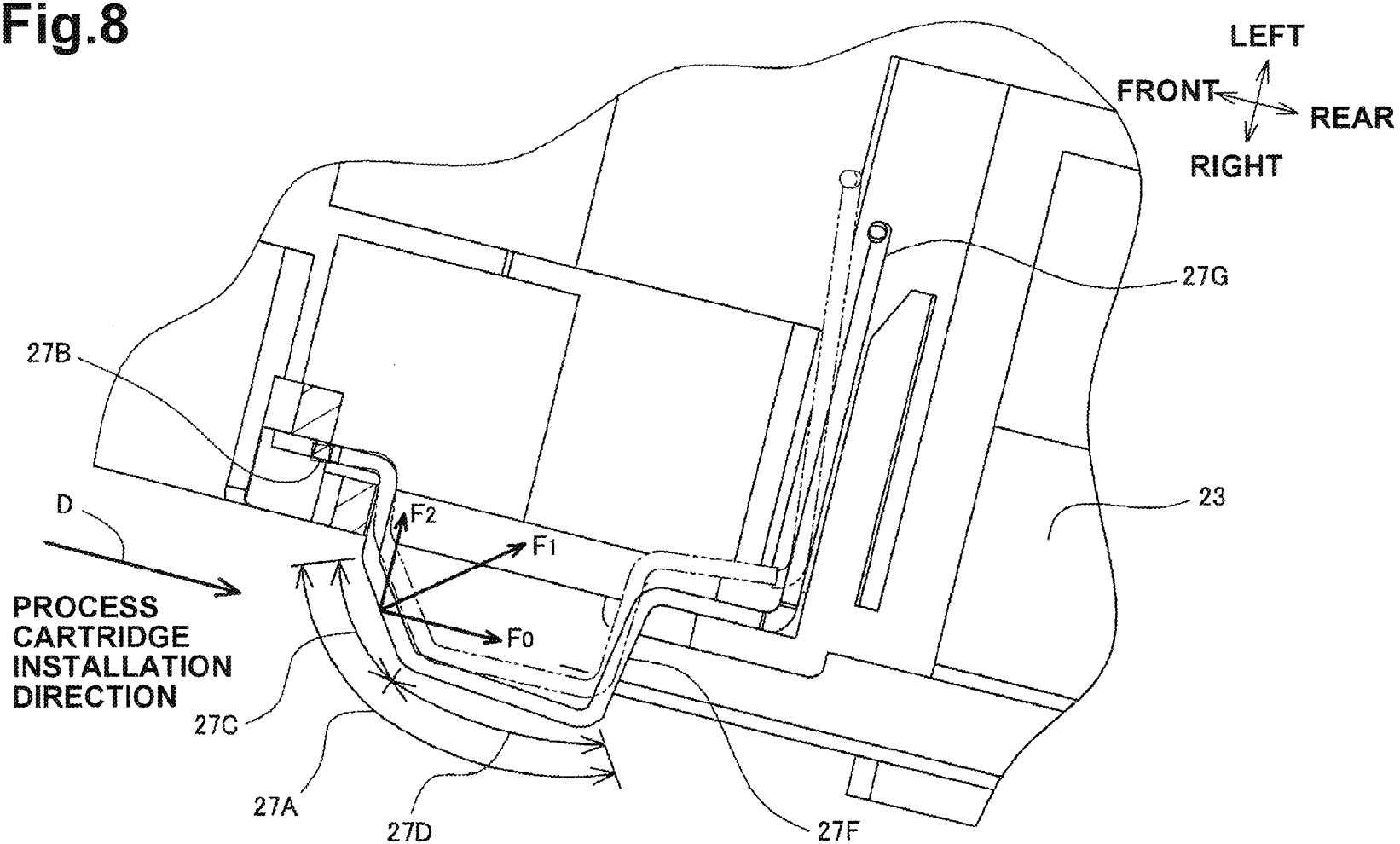
FIG. 8 is an enlarged view of a part A of FIG. 7.

When the terminal main body 27A receives a force, e.g. a force F2 in FIG. 8, which acts in a direction from the process cartridge 11 toward the side frame 23 (toward the inner wall side of the housing 5), the power supply terminal 27 pivots on the engaging portion 27B as a fulcrum such that the contact portion 27D moves toward the side frame 23. In FIG. 8, when the terminal main body 27A receives force F2, it moves from a state shown by solid lines to a state shown by chain double-dashed lines.

While the process cartridge 11 is mounted to the side frame 23, a part of the process cartridge 11 contacts the inclined portion 27C, and the inclined portion 27C receives a force F0, which acts in a parallel direction relative to the installation direction.

The inclined portion 27C is inclined in the installation direction D such that the side of the inclined portion 27C closer to the engaging portion 27B is disposed toward the side frame 23. Thus, the inclined portion 27C receives a force F2 acting from the process cartridge 11 toward the side frame 23, as a component force of the force F0.

Thus, the terminal main body 27A pivots on the engaging portion 27B as the fulcrum from the state shown by the solid lines to the state shown by the chain double-dashed lines. When the installation of the process cartridge 11 is completed, the contact portion 27D is positioned in parallel with the installation direction D as shown by the chain double-dashed lines and contacts the power-supplied portion 25.

The power supply terminal 27 of the illustrative embodiment includes the terminal main body 27A that protrudes from the side frame 23 toward the process cartridge 11 and extends from the upstream side to the downstream side in the installation direction of the process cartridge 11. The power supply terminal 27 also includes the engaging portion 27B that is provided upstream from the terminal main body 27A in the installation direction and protrudes in a direction perpendicular to the installation direction and engages the side frame 23. With this configuration, the power supply terminal 27 is prevented from being separated from the side frame 23 even if a great force acts on the terminal main body 27A.

At the installation of the process cartridge 11, the power supply terminal 27 contacts the process cartridge 11 first on an upstream side from the terminal main body 27A in the installation direction. Thus, the upstream side from the terminal main body 27A is subjected to the greatest amount of force in the power supply terminal 27.

However, in this illustrative embodiment, as the engaging portion 27B is provided on the upstream side from the terminal main body 27A and subjected to the greatest amount of force in the power supply terminal 27, the power supply terminal 27 is firmly engaged with the side frame 23 at the engaging portion 27B.

Thus, even if a great force acts on the terminal main body 27A at the installation of the process cartridge 11, the power supply terminal 27 can be prevented from being separated from the side frame 23.

In this illustrative embodiment, the engaging portion 27B is an integral part of the power supply terminal 27 and is made by bending the upstream side, in the installation direction, of the power supply terminal 27.

The inclined portion 27C is provided on the upstream side of the terminal main body 27A in the installation direction. The inclined portion 27C is inclined in the installation direction in a state where the process cartridge 11 is demounted. When the process cartridge 11 is installed, the inclined portion 27C guides the process cartridge 11 to a predetermined position, and thus the process cartridge 11 can be installed smoothly.

Force F0 is distributed into forces F1 and F2 at the inclined portion 27C. This distribution reduces an impulsive force generated at the installation of the process cartridge 11, which prevents the power supply terminal 27 from being separated from the side frame 23 due to the impulsive force.

The terminal main body 27A pivots on the engaging portion 27B during installation of the process cartridge 11, and the contact portion 27D is moved to a position in parallel with the installation direction D and in contact with the power-supplied portion 25 at the completion of the installation of the process cartridge 11. Thus, electrical contact between the power supply terminal 27 and the power-supplied portion 25 is established.

As the contact portion 27D is positioned generally parallel to the installation direction D, when the process cartridge 11 is removed from the side frame 23, it is unlikely that a force acting in a direction different from the installation direction will be generated, and thus the impulsive force during removal of the process cartridge 11 can be reduced. Thus, the power supply terminal 27 can be prevented from being separated from the side frame 23 due to the impulsive force.

This illustrative embodiment shows, but is not limited to, a power supply terminal made of wire S. In illustrative alternative embodiments, the power supply terminal may be made of a flat wire or a band-shaped wire.

This illustrative embodiment shows, but is not limited to, a power supply terminal manufactured by bending a wire.

This illustrative embodiment shows, but is not limited to, an engaging portion 27B that is bent to protrude in a direction orthogonal to the width direction of the laser printer 1, that is, in a vertical direction, among directions orthogonal to the installation direction D. The engaging portion 27B may be formed by bending to protrude in a direction parallel to the width direction among the directions orthogonal to the installation direction D.

This illustrative embodiment shows, but is not limited to, the monochrome laser printer. It will be appreciated that this illustrative embodiment also applies to other types of image forming apparatuses, a color laser printer, an inkjet printer, and a facsimile machine having such a printer as well.

This illustrative embodiment shows, but is not limited to, a light exposing device configured to expose the photosensitive drum 11A to laser light. A light exposing device configured to expose the photosensitive drum 11A to light due to a number of LEDs may be used.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a body frame defining an opening configured to receive a cartridge installed in an installation direction; and a power supply terminal disposed on the body frame, the power supply terminal being configured to supply power to an installed cartridge by making contact with a power supplied portion disposed in the cartridge, the power supply terminal including:

a main body protruding from the body frame toward the opening and extending from an upstream side, with respect to the installation direction, toward a downstream side; and an engaging portion disposed upstream from the main body in the installation direction and protruding in a direction orthogonal to the installation direction, the engaging portion being configured to engage the body frame.

2. The image forming apparatus according to claim 1, wherein the main body and the engaging portion are integrally formed of a bent wire.

3. The image forming apparatus according to claim 2, wherein the engaging portion includes an upstream end of the power supply terminal bent in the installation direction.

4. The image forming apparatus according to claim 1, wherein the power supply terminal includes an inclined portion, which is disposed on an upstream side of the main body and is inclined in the installation direction in a state in which a cartridge is not installed.

5. The image forming apparatus according to claim 1, wherein the power supply terminal includes a supporting portion that is configured to elastically support the main body, and the main body is configured to move toward and away from the body frame.

6. The image forming apparatus according to claim 1, wherein the main body is configured to pivot on the engaging portion during installation of a cartridge, and the main body includes a contact portion that is configured to contact a power supplied portion disposed in an installed cartridge, the power supplied portion being parallel to the installation direction in a state where the installed cartridge is attached to the body frame.

7. An image forming apparatus comprising:

a body frame including a pair of side frames on opposing sides of the body frame defining an opening configured to receive a cartridge installed in an installation direction; and a pair of power supply terminals, each disposed on one of the side frames, each of the power supply terminals being configured to supply power, each power supply terminal including:

a main body protruding from the side frame toward the opening and extending from an upstream side, with respect to the installation direction, toward a downstream side; and an engaging portion disposed upstream from the main body in the installation direction and protruding in a direction orthogonal to the installation direction, the engaging portion being configured to engage the side frame.

* * * * *